US010978819B2

(12) United States Patent
Amini et al.

(10) Patent No.: US 10,978,819 B2
(45) Date of Patent: Apr. 13, 2021

(54) MECHANICAL SPRING DIODE CONTACT

(71) Applicant: Apple Inc., Cupertino, CA (US)

(72) Inventors: Mahmoud R. Amini, Sunnyvale, CA (US); James M. Jeon, Mountain House, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/138,911

(22) Filed: Sep. 21, 2018

(65) Prior Publication Data

US 2020/0099150 A1 Mar. 26, 2020

(51) Int. Cl.
*H01R 12/73* (2011.01)
*H01R 12/70* (2011.01)

(52) U.S. Cl.
CPC ..... *H01R 12/735* (2013.01); *H01R 12/7023* (2013.01)

(58) Field of Classification Search
CPC .. H01R 12/82; H01R 12/735; H01R 12/7023; H01R 12/721; H01R 12/6275
USPC ..... 439/326, 541.5
See application file for complete search history.

(56) References Cited

U.S. PATENT DOCUMENTS 4,370,017 A * 1/1983 Grabbe ..... H01R 12/716 439/188
4,722,700 A * 2/1988 Kuhn ..... H01R 12/82 439/629
5,067,904 A * 11/1991 Takeuchi ..... H05K 7/1023 439/72
5,415,573 A * 5/1995 Chen ..... H01R 12/721 439/876
5,755,585 A * 5/1998 Cheng ..... H01R 12/83 439/326
6,319,035 B1 * 11/2001 Choy ..... H01R 12/721 439/326
6,358,061 B1 * 3/2002 Regnier ..... H01R 13/6471 439/60
6,666,702 B1 * 12/2003 Pickles ..... H01R 12/716 439/326
7,338,307 B2 * 3/2008 Zhang ..... H01R 12/57 439/326
7,494,361 B2 * 2/2009 Ho ..... H01R 13/635 439/260
8,308,499 B2 * 11/2012 Yeh ..... H01R 13/514 439/326
8,968,019 B2 3/2015 Hack et al.

* cited by examiner

*Primary Examiner* — Hien D Vu
(74) *Attorney, Agent, or Firm* — Kilpatrick Townsend & Stockton, LLP

(57) ABSTRACT

Sockets that have a simplified design and are readily manufactured, and also provide easy access for users to change cards while allowing the use of thinner device enclosures.

11 Claims, 14 Drawing Sheets

MECHANICAL SPRING DIODE CONTACT

BACKGROUND

Computers are a collection of many circuits operating together. These circuits may include central processing units, memories, graphics processors, networking circuits, and others. Many of these circuits, such as central processing units, may be directly placed on a main or motherboard, also known as a main logic board. Other circuits, such as memories and graphics processors, may reside on separate boards, also known as daughter boards or cards. These daughter boards or cards may connect to the main logic board. This connection is often made using one or more sockets, where the sockets are fixed to the main logic board and the memories or graphics processors are inserted into the sockets.

These daughter boards or cards are typically inserted into these sockets at an angle that is at least somewhat orthogonal to the main logic board. This configuration makes it relatively easy for a user to pull cards and insert new ones. For example, this configuration may make it easy for users to upgrade cards or replace defective cards. This configuration also reduces the footprint or area on the main logic board that is consumed by the card.

These sockets may include contacts that make connections with contacts or pads on the cards or boards. Inserting and extracting boards or cards into and out of these sockets may wear or cause damage to the contacts. This damage may cause the sockets to be nonfunctional. Accordingly, it may be desirable that these sockets have contacts that are able to withstand the removal and insertion of cards into and out of the socket.

Similar to these sockets, connector inserts may be inserted into, and removed from, connector receptacles up to several times a day. Accordingly, it may be desirable that these contacts be useful in connector inserts and connector receptacles.

Thus, what is needed are sockets that have a simplified design and are readily manufactured, and also have contacts that are able to withstand the insertion and extraction of cards into and out of the socket. It may also be desirable that these contacts be useful in connector inserts and connector receptacles.

SUMMARY

Accordingly, embodiments of the present invention may provide sockets that have a simplified design and are readily manufactured, and also have contacts that are able to withstand the insertion and extraction of cards into and out of the socket. Embodiments of the present invention may further utilize these contacts in connector inserts and connector receptacles.

An illustrative embodiment of the present invention may provide a socket having a receptacle with a slot to accept a card. The receptacle may be arranged to accept a card when it is inserted into the receptacle in a direction that is at least somewhat orthogonal to a board on which the socket is mounted. The receptacle may allow the card to be rotated such that it is at least somewhat parallel to the board. The socket may include latch arms on each side of the receptacle, where the latch arms include locking features to secure the card in place after rotation.

These and other embodiments of the present invention may provide a plurality of sockets that may be adjacent to, and aligned in parallel with, each other. In this configuration, when a card is inserted in a receptacle of a bottom socket, the latch arms of an adjacent top socket may interfere with the card's rotation. Accordingly, the locking features on the latch arms of the top socket may be aligned with notches on the card when the card is inserted into the bottom socket. This may allow a card in the receptacle of the bottom socket to be rotated into position without interference from locking features on the latch arms of the top socket. While these adjacent and aligned sockets may be separate sockets, in these and other embodiments of the present invention, one, two, or more than two such sockets may be combined into a single unit.

These and other embodiments of the present invention may provide contacts for sockets where the contacts may be able to withstand the insertion and removal of cards into and out of the socket. In these and other embodiments of the present invention, a contact may be susceptible to damage during an extraction of a card from a socket. For example, a contact may catch on an edge of a board and may be bent as the card is extracted. Accordingly, a stiffness or spring constant of the contact may be increased to protect the contact. This increased spring constant may help to protect the contacts from being bent or deformed when the connector insert is extracted from the connector receptacle. But this increase in stiffness may increase an insertion force that needs to be overcome by a user when the user inserts a card into the socket. Accordingly, the contacts may be arranged to have a lower, first spring constant during an insertion of a card to reduce the necessary insertion force. The contacts may further have a second, higher spring constant during an extraction of the card to prevent the contacts from being bent or otherwise damaged. At the same time, embodiments of the present invention may provide a sufficient normal force such that contacts in the socket form a good electrical connection with corresponding contacts on the card when the card is inserted in the socket.

These and other embodiments of the present invention may provide contacts having a lever arm of a first length during an insertion of a card and a lever arm of a second, shorter length during an extraction of the card. The contact may include a right angle formed by a first beam portion and a second beam portion. During an insertion, the right angle may move in a first direction, thereby providing a longer lever arm, a lower spring constant, and a lower stiffness. During an extraction, the right angle may be blocked from moving in a second, opposite direction, thereby providing a shorter lever arm, a higher spring constant, and a higher stiffness. These contacts may be stamped to include a loop, where the loop is broken to form the right angle that may move in the first direction, and a stop that may prevent the right angle from moving in the second direction. The loop may be broken by a multiple half-shears in opposite directions.

These and other embodiments of the present invention may provide contacts for connector inserts or connector receptacles where the contacts may be able to withstand the insertion and removal of connector inserts into and out of connector receptacles. These contacts may be located on a corresponding connector structure, such as a connector tongue, and may increase an extraction force (as compared to an insertion force) needed to extract a connector insert from a corresponding connector receptacle.

Embodiments of the present invention may be used to provide sockets that may hold one or more cards. These cards may be memory cards, such as SO-DIMM, DIMM, or other cards. They may also be other types of cards, such as graphics cards, networking cards, audio cards, or other types of cards, boards, modules, or other devices.

In various embodiments of the present invention, contacts, tabs, latches, and other conductive portions of a socket, connector insert, or connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as housings and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. These sockets may be attached or be mounted on printed circuit boards or other boards that may be formed of FR-4 or other material.

Embodiments of the present invention may provide sockets, connector inserts, or connector receptacles that may be located in various types of devices such as portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices. The sockets may be sockets for small outline dual in-line memory module (SO-DIMM) sockets, dual in-line memory module (DIMM) sockets, or other types of memory or other sockets. They may also be other types of sockets, such as sockets for graphics cards, networking cards, audio cards, or other types of cards, boards, modules, or other devices. These connector receptacles and connector inserts may provide interconnect pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide sockets, connector receptacles, and connector inserts that may be used to provide a reduced set of functions for one or more of these standards. In various embodiments of the present invention, these interconnect paths provided by these sockets, connector inserts, and connector receptacles may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
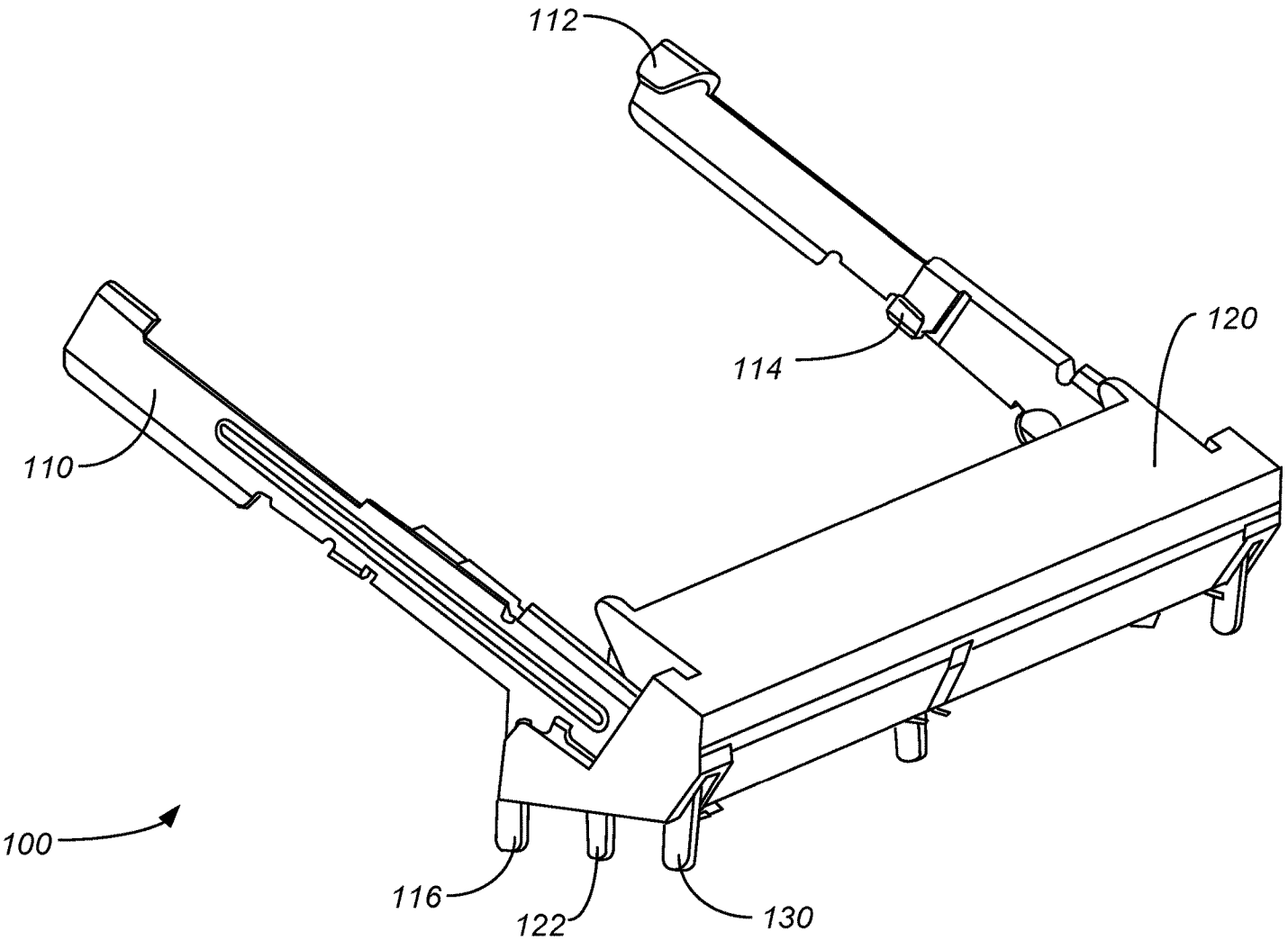
FIG. 1 illustrates a socket according to an embodiment of the present invention.

FIG. 1 illustrates a socket according to an embodiment of the present invention. This figure, as with the other included figures, is shown for illustrative purposes and does not limit either the possible embodiments of the present invention or the claims.

This figure illustrates socket 100. Socket 100 may include receptacle 120 supporting latch arms 110. A card, such as a memory card, or other type of card 400 (shown in FIG. 6) may have a first end that may be inserted into receptacle 120. Contacts (not shown) on the first end of card 400 may form electrical connections with front side contacts 710 and back side contacts 720 (shown in FIG. 7) in receptacle 120. Latch arms 110 may extend from receptacle 120. Latch arms 110 may include top locking feature 112 and bottom locking feature 114 that may hold the card in place when the card is inserted into receptacle 120. Latch arms 110 may further include tabs 116. Tabs 116 may be inserted into, and soldered in, openings in a printed circuit board or other appropriate substrate on which socket 100 is mounted, where they may connect to ground traces or planes (not shown.) Receptacle 120 may include posts 122. Posts 122 may be inserted into openings in the printed circuit board or other appropriate substrate. Socket 100 may further include tabs 130 in receptacle 120. Tabs 130, like tabs 116, may be inserted into, and soldered in, openings in the printed circuit board or other appropriate substrate, where they may connect to ground traces or planes.

Figure 2:
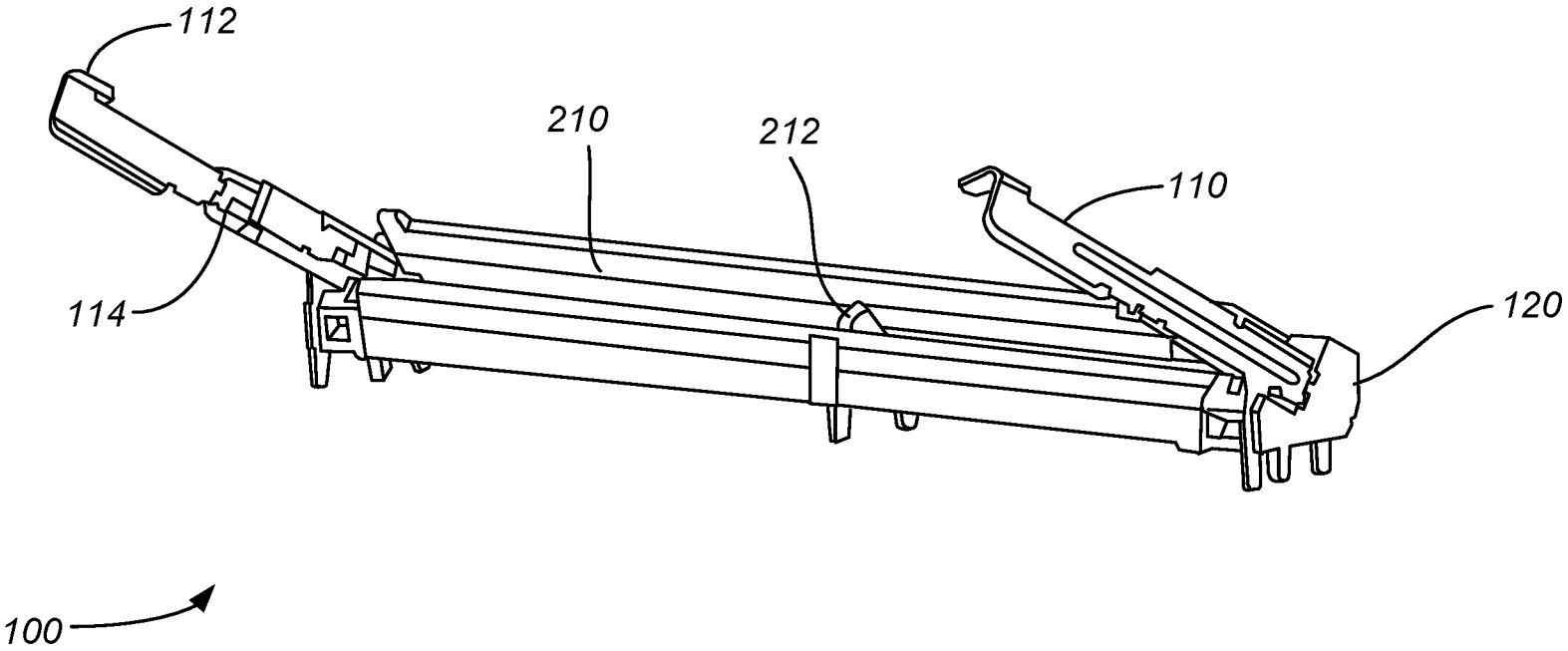
FIG. 2 illustrates a socket according to an embodiment of the present invention.

FIG. 2 illustrates a socket according to an embodiment of the present invention. Receptacle 120 of socket 100 may include slot or opening 210 for accepting an end of card 400 (shown in FIG. 6.) Slot or opening 210 may include a center tab 212. Center tab 212 may help to ensure that card 400 is inserted into socket 100 in a proper orientation. Latch arms 110 may extend from receptacle 120. Latch arms 110 may include a bottom locking feature 114 to hold card 400 from a bottom side and a top locking feature 112 to hold card 400 from a top side.

Figure 3:
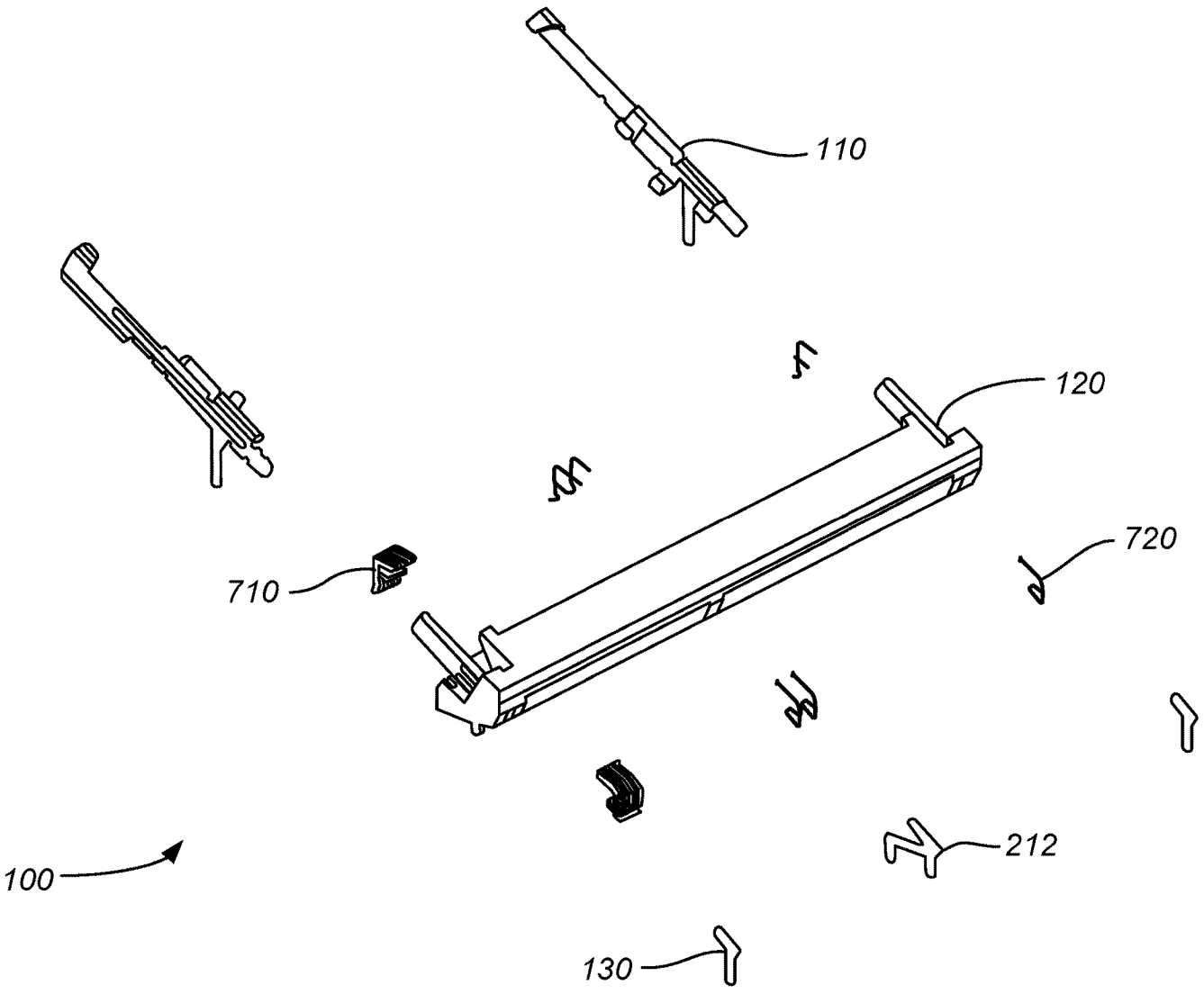
FIG. 3 is an exploded view of a socket according to an embodiment of the present invention.

FIG. 3 is an exploded view of a socket according to an embodiment of the present invention. Receptacle 120 may support front side contacts 710 and back side contacts 720. Latch arms 110 may be attached to receptacle 120. Center tab 212 may be inserted into receptacle 120. Tabs 130 may be inserted into ends of receptacle 120.

Receptacle 120 may be formed of plastic, LDS, or other nonconductive materials. Receptacle 120 may be formed by injection, insert, or other type of molding, 3-D printing, or other process. Front side contacts 710 and back side contacts 720 may be formed of copper, steel, stainless steel, or other conductive materials. Front side contacts 710 and back side contacts 720 may be formed by stamping, forging, printing, or other process. Latch arms 110 may be formed of aluminum, steel, stainless steel, plastic, or other material. Latch arms 110 tabs 130, and center tab 212 may be formed by stamping, forging, printing, or other process.

In these and other embodiments of the present invention, card 400 (shown in FIG. 6) may be inserted into socket 100 in a direction that is at least nearly orthogonal to a board on which the socket is mounted. For example, the socket may be designed such that card 400 may be inserted at a 60 degree angle relative to the board. In these and other embodiments of the present invention, this angle may be a different angle, such as an angle of 90, 75, 65, 55 degrees, or other angle. Once inserted, card 400 may be rotated towards a position that is at least somewhat parallel to the board. For example, socket 100 may be designed such that card 400 may be locked in place by latch arms 110 at a 30 degree angle relative to the board. In these and other embodiments of the present invention, this angle may be a different angle, such as an angle of 45, 40, 35, 25 degrees, or other angle. An example is shown in the following figure.

Figure 4:
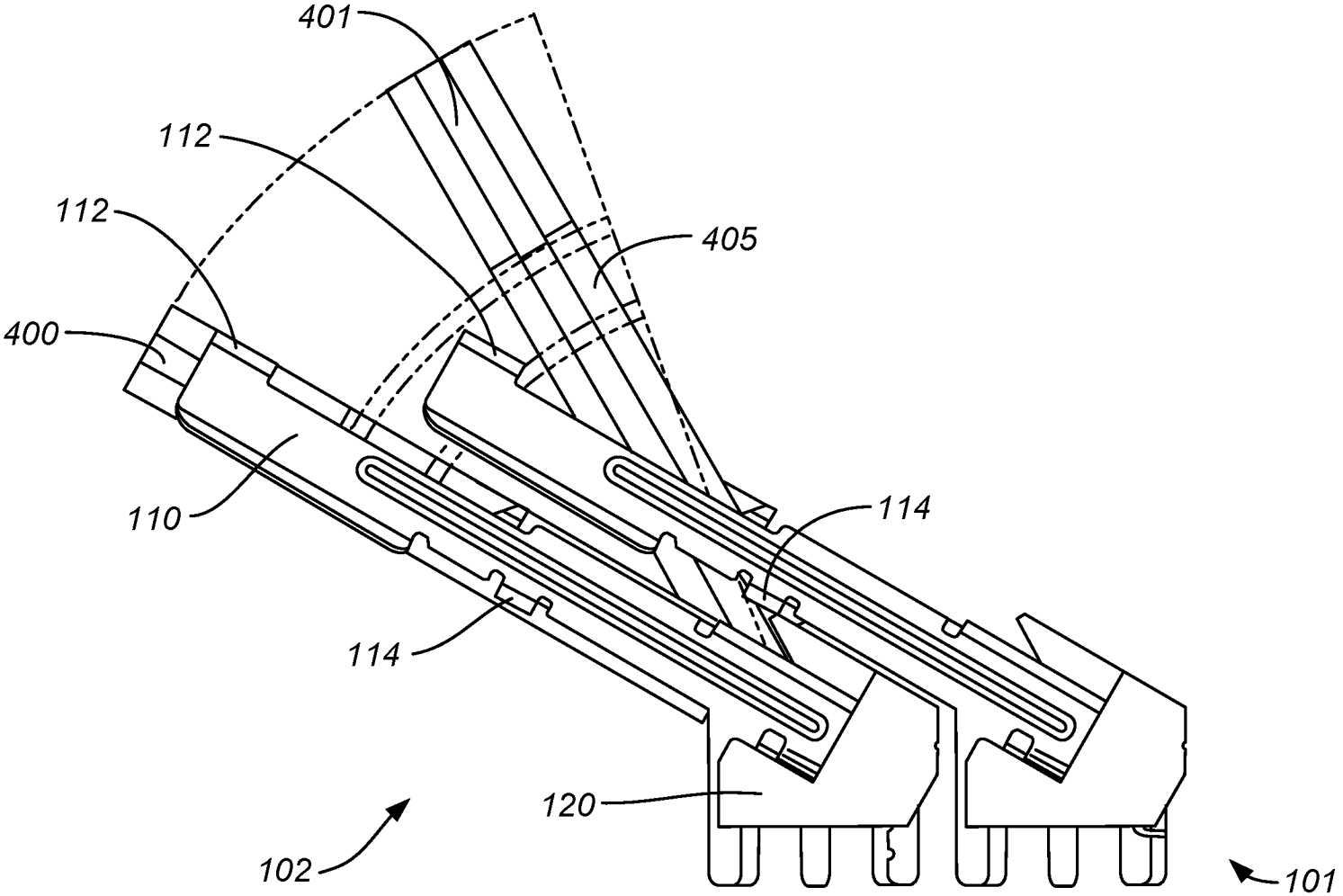
FIG. 4 illustrates the insertion of a card into a socket according to an embodiment of the present invention.

FIG. 4 illustrates the insertion of a card into a socket according to an embodiment of the present invention. In this example, card 400 may begin at position 401 as it is inserted into receptacle 120 of bottom socket 102. Card 400 may then be rotated into its final position, where it is locked in place in latch arms 110 of bottom socket 102. Specifically, top locking feature 112 may hold a top of card 400, while bottom locking feature 114 may hold the bottom of card 400.

In this example, card 400, may be inserted at a 60 degree (or other) angle relative to a board on which bottom socket 102 is mounted (shown as position 401). Card 400 may be rotated into a final locked position in latch arms 110 at a 30 degree (or other) angle relative to the board.

In these and other embodiments of the present invention, more than one socket 100 may be included. These may include top socket 101 and bottom socket 102. As card 400 is rotated from its insertion position 401 to its locked position in bottom socket 102, it may be interfered with by latch arms 110 on top socket 101. For example, top locking feature 112 of top socket 101 may block card 400 as it is rotated. Accordingly, top locking feature 112 of top socket 101 may be positioned to be aligned with notch 405 of card 400. This may allow card 400 be rotated into the locked position without interference from top locking feature 112 of top socket 101.

Similarly, it may be desirable to avoid interference with bottom locking feature 114 of top socket 101. Accordingly, bottom locking feature 114 may be positioned such that card 400 is below and clears bottom locking feature 114 when card 400 is inserted and rotated into a locked position in bottom socket 102. While in this example bottom socket 102 and top socket 101 are shown as separate sockets, these and other embodiments of the present invention may provide combined sockets having two or more receptacles for two or more cards.

Figure 5:
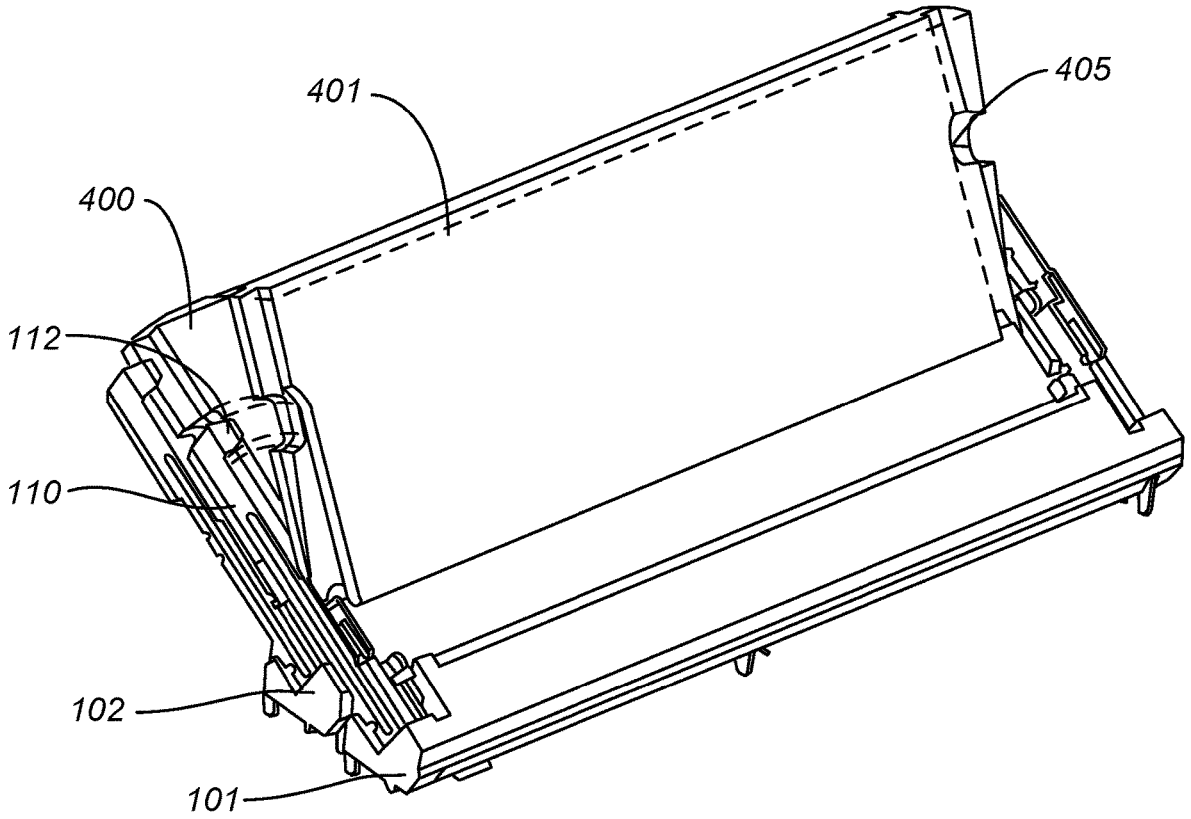
FIG. 5 illustrates the insertion of a card into a socket according to an embodiment of the present invention.

FIG. 5 illustrates the insertion of a card into a socket according to an embodiment of the present invention. Again, top locking feature 112 on latch arms 110 of top socket 101 may be aligned with notch 405 on card 400. This may allow card 400 to be rotated from the inserted position 401 to the locked position (shown as card 400) as shown in bottom socket 102.

Figure 6:
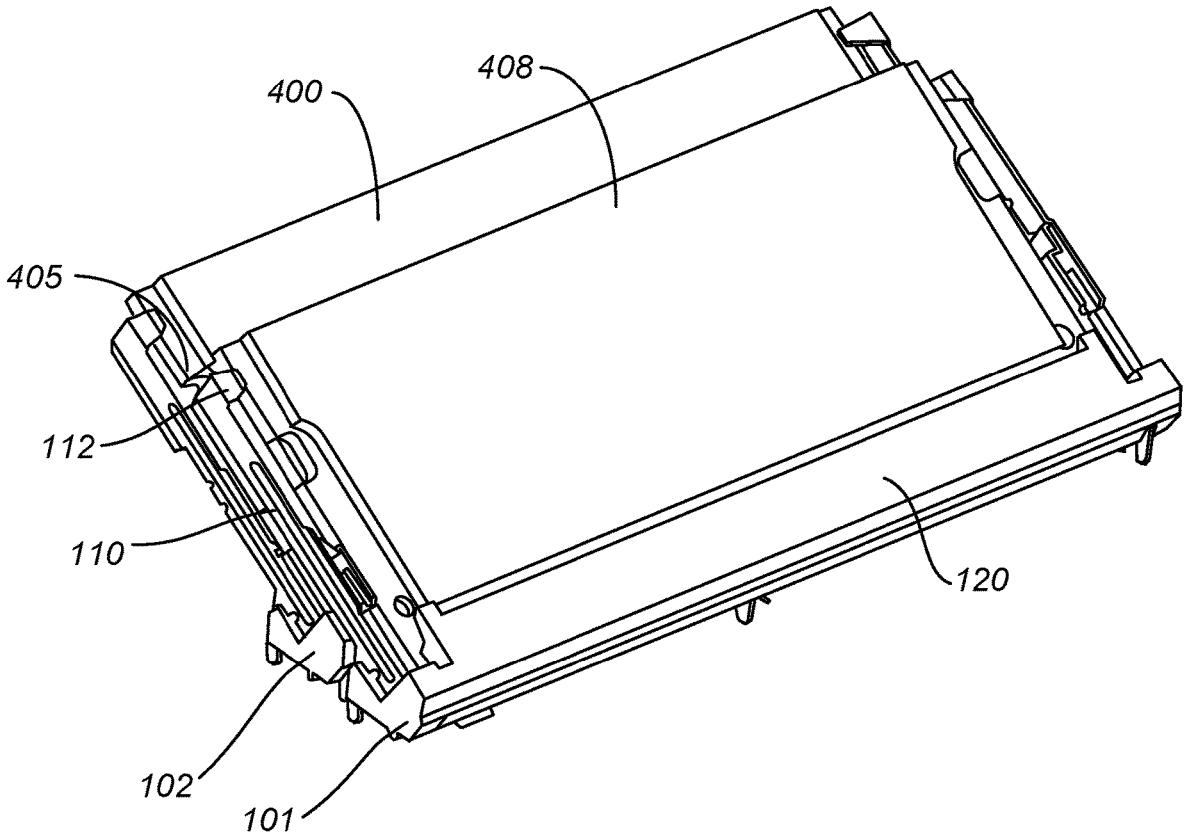
FIG. 6 illustrates cards located in sockets according to an embodiment of the present invention.

FIG. 6 illustrates cards located in sockets according to an embodiment of the present invention. Specifically, card 400 is shown in bottom socket 102 while card 408 is in top socket 101. As can be seen, notch 405 on card 400 may be aligned with top locking features 112 of latch arms 110 of top socket 101.

As card 400 is extracted from socket 100, front side contacts 710 (shown in FIG. 7) in slot or opening 210 (shown in FIG. 2) of receptacle 120 may become bent or otherwise damaged. Accordingly, embodiments of the present invention may provide contacts that provide an increased spring constant. This increased spring constant may help to prevent the contacts from being bent or otherwise damaged. An example is shown in the following figures.

Figure 7:
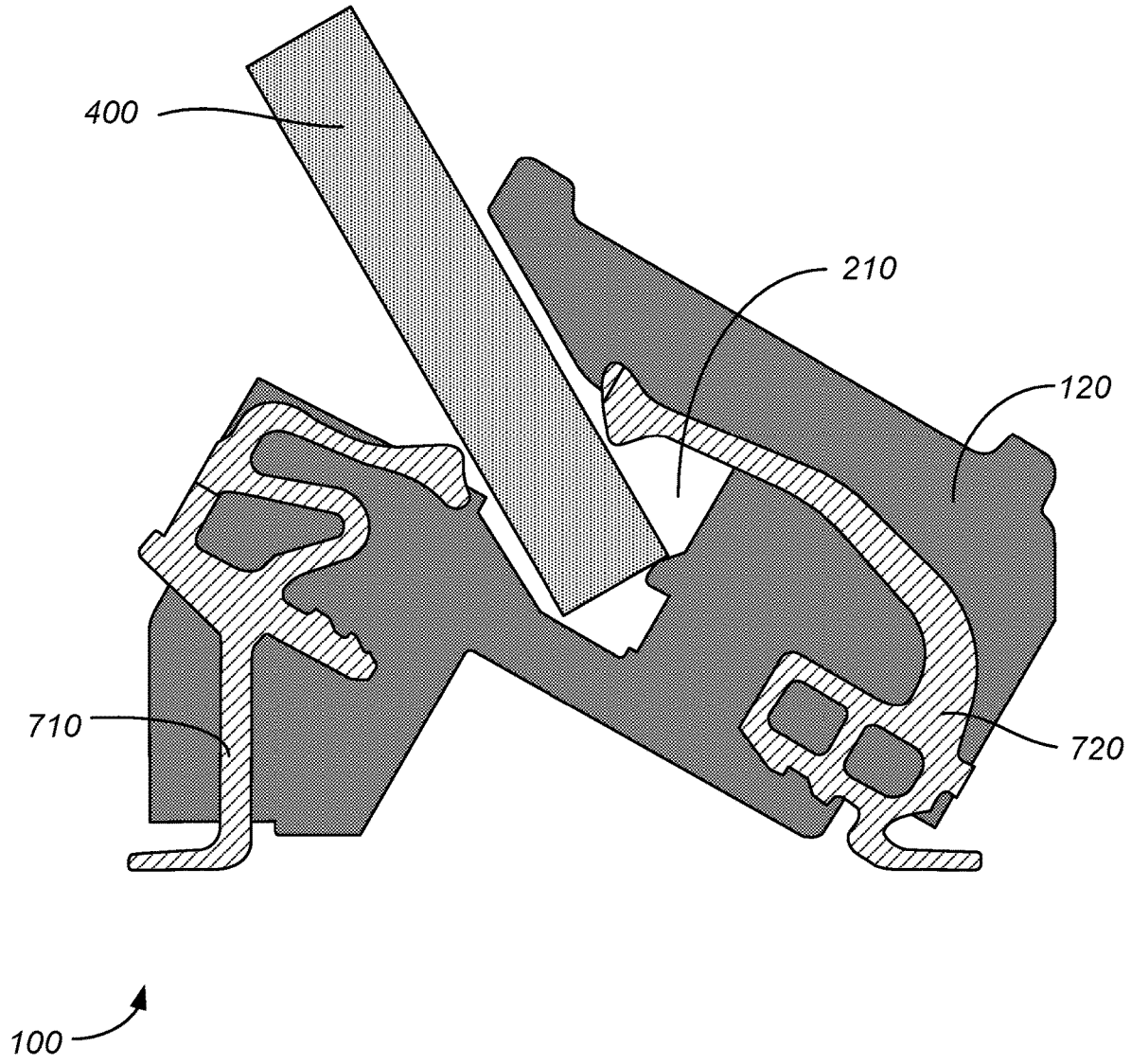
FIG. 7 illustrates a side view of a card being inserted into a socket according to an embodiment of the present invention.

FIG. 7 illustrates a side view of a card being inserted into a socket according to an embodiment of the present invention. In this example, card 400 is inserted into a socket 100 having receptacle 120. Front side contacts 710 may be located near a front of receptacle 120, while back side contacts 720 may be located towards a rear of receptacle 120.

Figure 8:
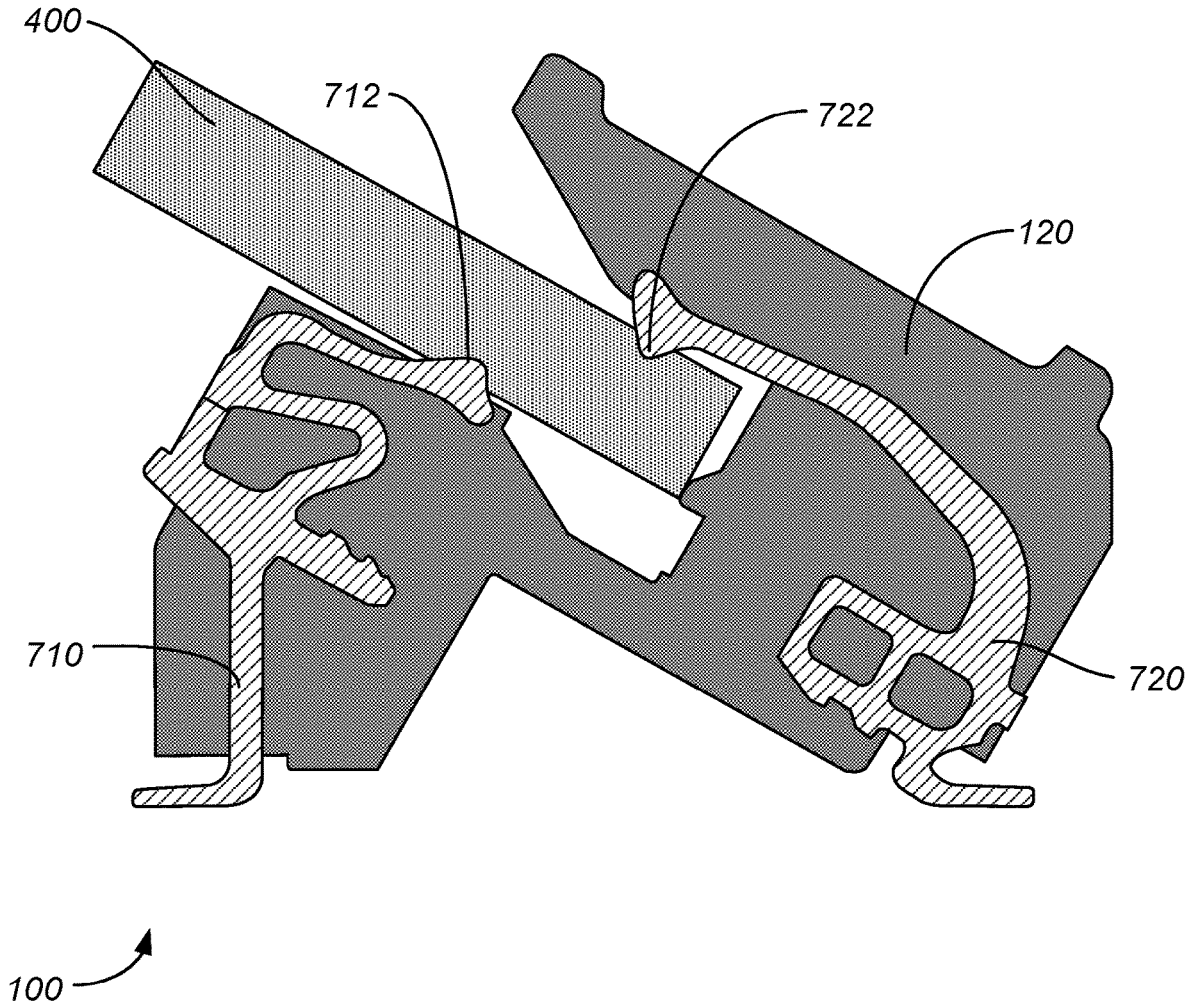
FIG. 8 illustrates a side view of a card that has been inserted into a socket according to an embodiment of the present invention.

FIG. 8 illustrates a side view of a card that has been inserted into a socket according to an embodiment of the present invention. In this example, card 400 may be locked by latch arms 110 (shown in FIG. 1.) Contacting portions 712 of front side contacts 710 may form physical and electrical connections with contacts (not shown) on a bottom side of card 400. Contacting portions 722 of back side contacts 720 may form physical and electrical connections with contacts (not shown) on a top side of card 400. During an extraction of card 400, contacting portions 712 of front side contacts 710 may be bent backwards and damaged. To prevent this, front side contacts 710 may have a higher spring constant during extraction. This may increase the extraction force and may help to prevent contact portions 712 from becoming bent towards the front opening in receptacle 120 as card 400 is extracted. Further details are shown in the following figure.

Figure 9:
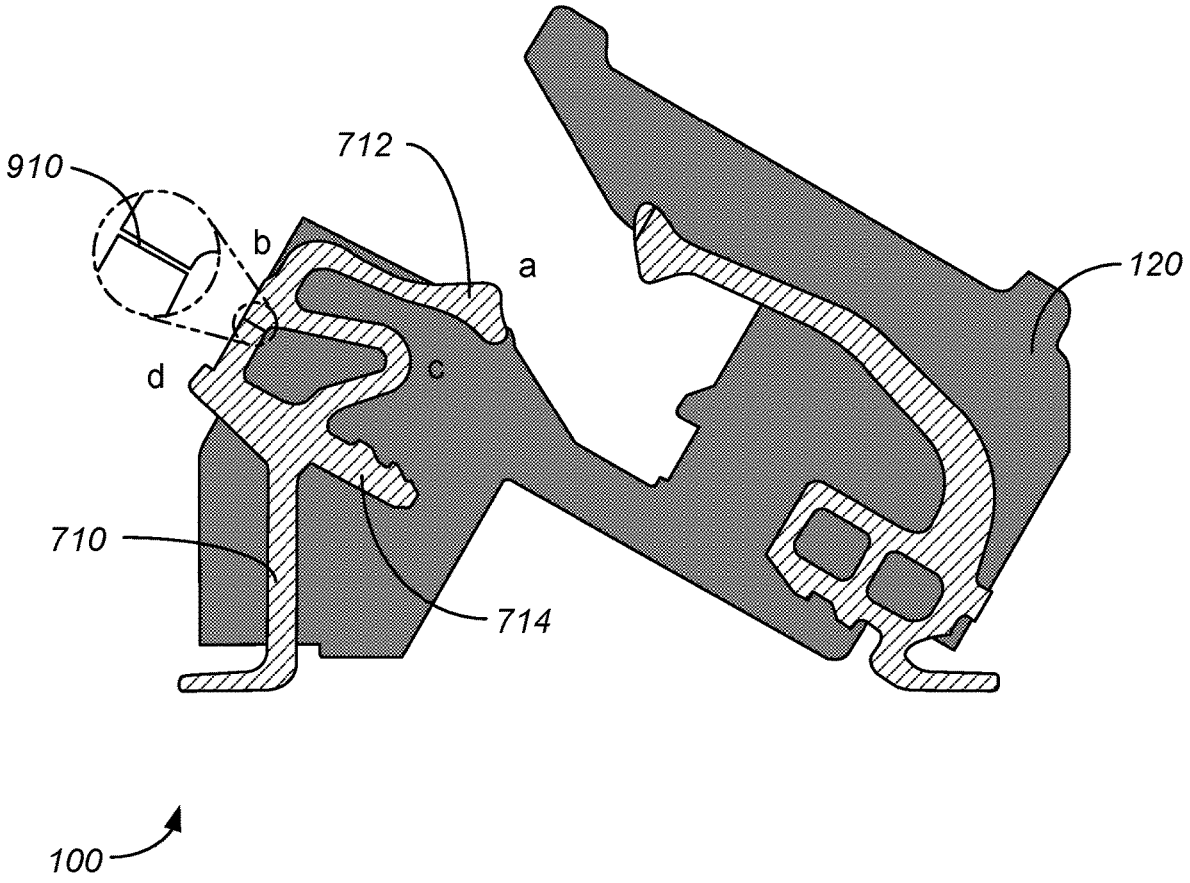
FIG. 9 illustrates further details of a contact according to an embodiment of the present invention.

FIG. 9 illustrates further details of a contact according to an embodiment of the present invention. During insertion, card 400 (shown in FIG. 7), may encounter front side contacts 710 at its contacting portion 712, labeled here as "a." This may cause the contacting portion 712 to be bent downward as shown in this figure. This motion may cause portion "b" to separate from portion "d." Point "c" move downward as well. That is, an insertion of a card may bend front side contacts 710 through portions a, b, and c. This relatively long lever arm may provide a relatively low spring constant for front side contacts 710 and lower the forces needed during insertion. During extraction, contacting portion 712, or "a" may be pushed forward in receptacle 120. This may cause portion "b" to a contact portion "d" thereby limiting the travel of contacting portion 712. This reduced arm length (a and b) may increase a spring constant for front side contacts 710 and increase a retention force against card 400 (shown in FIG. 6) during extraction.

Front side contacts 710 may be stamped to include a loop (the two paths joining "c" and "d"), where the loop is broken at location 910 to form right angle ("b" and "c") that may move in the first direction (upward as drawn), and a stop at location 910 that may prevent the right angle from moving in the second direction (downward as drawn.) The loop may be broken by a multiple half-shears in opposite directions. Front side contact 710 may be sheared at location 910 in directions that are into and out of the drawing as shown, that is, in the directions that are orthogonal to the plane identified by the portions "a," "b," "c," and "d." This shearing may be done incrementally in alternating directions until "b" and d" are separated at location 910 as shown.

The latch arms and other features of these sockets may be varied in these and other embodiments of the present invention. Examples are shown in the following figures.

Figure 10:
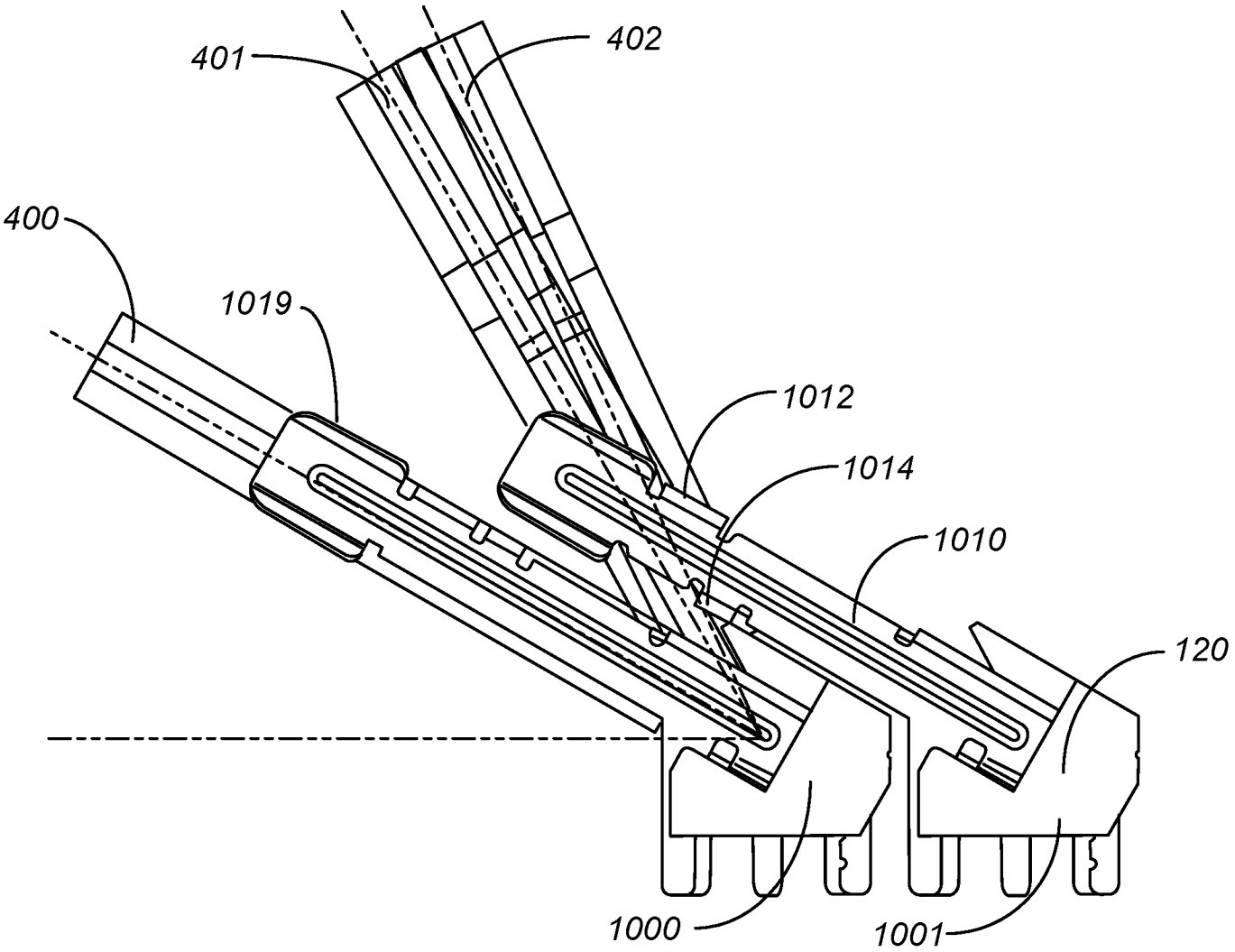
FIG. 10 illustrates the insertion of a card into a socket according to an embodiment of the present invention.

FIG. 10 illustrates the insertion of a card into a socket according to an embodiment of the present invention. In this example, card 400 may be inserted at position 401 into bottom socket 1000. Top socket 1001 may include top locking feature 1012 and bottom locking feature 1014 on latch arms 1010. In this example, top locking feature 1012 may be positioned closer to receptacle 120, as compared to the above examples. This may allow card 400 be inserted into position 401 before being rotated into place. That is, card 400 may clear top locking feature 1012 on top socket 1001 such that top locking feature 1012 does not interfere with card 400 as it is rotated into place. As before, bottom locking feature 1014 may be similarly located such that it does not interfere with the rotation of card 400 in bottom socket 1000. When card 400 is inserted at an excessive vertical angle, shown here as 402, card 400 may interfere with either or both top locking feature 1012 and bottom locking feature 1014. Latch arms 1010 may include thumb tabs 1019 to assist in removing card 400 from bottom socket 1000.

Figure 11:
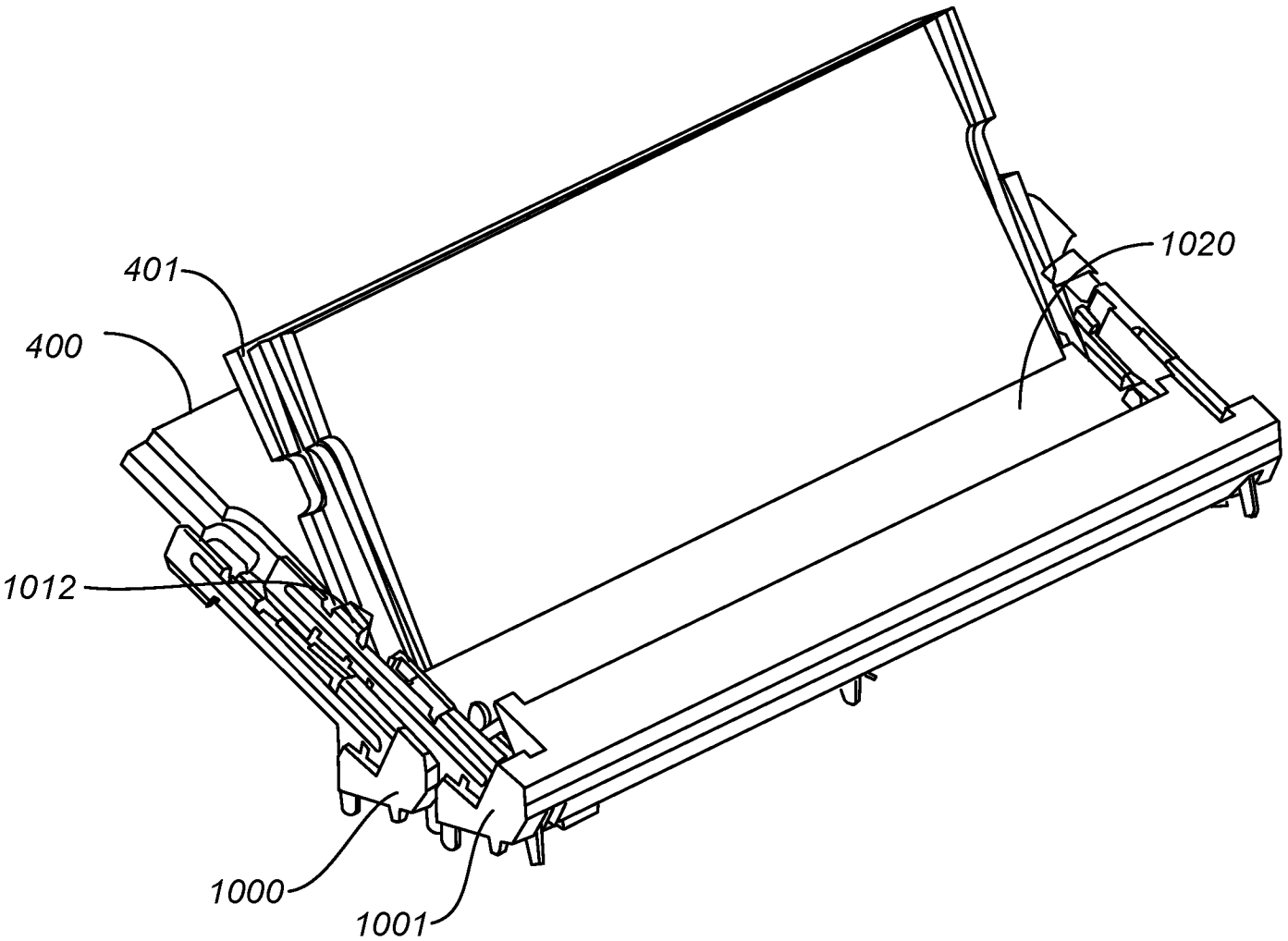
FIG. 11 illustrates the insertion of a card into a socket according to an embodiment of the present invention.

FIG. 11 illustrates the insertion of a card into a socket according to an embodiment of the present invention. In this example, card 400 may be inserted in position 401 and rotated into place. Since card 400 in position 401 clears top locking feature 1012, top socket 1001 does not interfere with card 400 as it is inserted into bottom socket 1000.

To help ensure that card 400 is not inserted in an excessively vertical position, a limiting feature may be placed on receptacle 120. An example is shown in the following figure.

Figure 12:
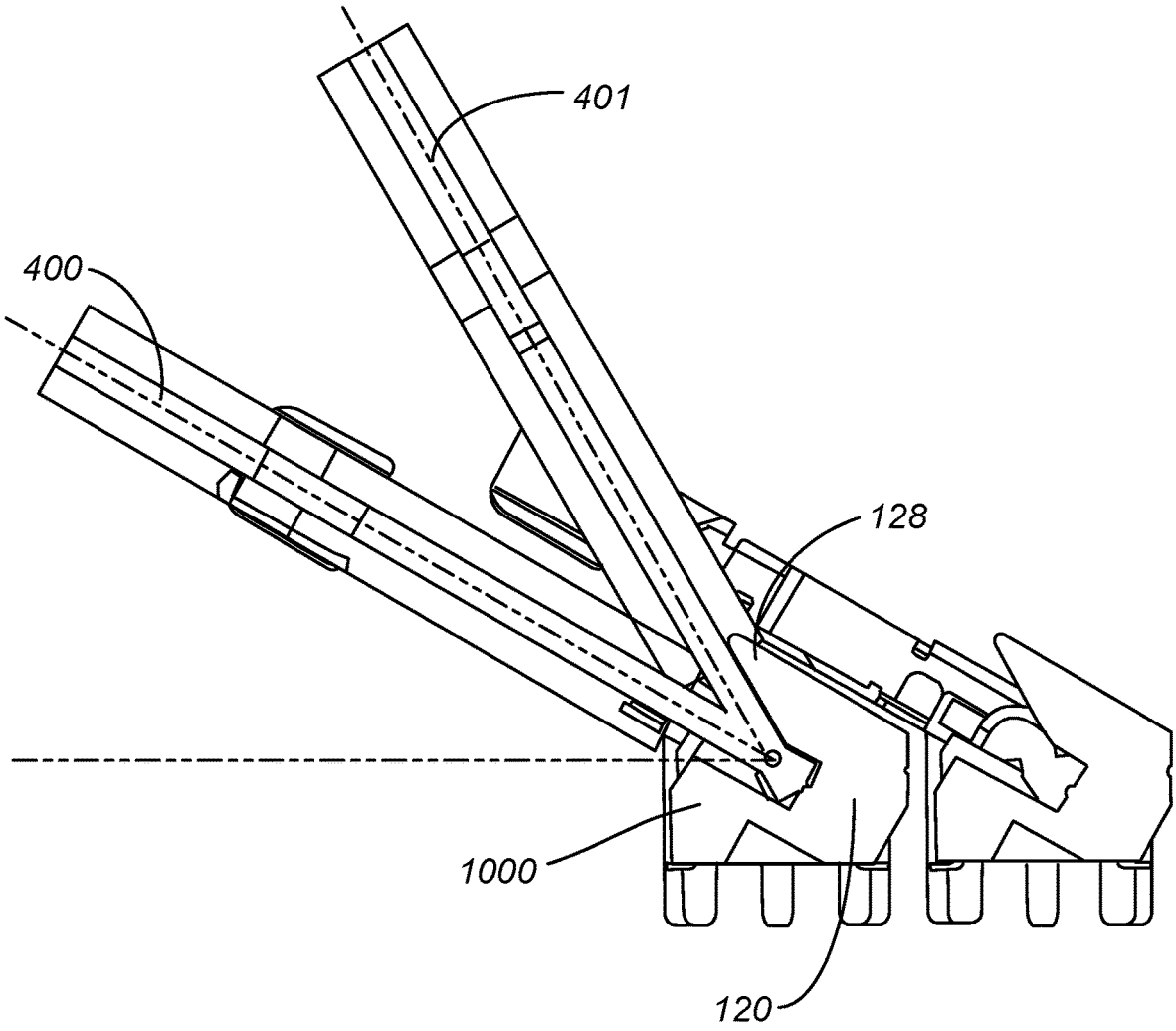
FIG. 12 illustrates a side view of a card being inserted into a socket according to an embodiment of the present invention.

FIG. 12 illustrates a side view of a card being inserted into a socket according to an embodiment of the present invention. In this example, limiting feature 128 on receptacle 120 may limit an angle at which card 400 may be inserted into bottom socket 1000. The maximum vertical position of card 400 is shown in this example as position 401.

Just as the above contacts may help to prevent damage in a socket, they may be useful in connector inserts and connector receptacles. An example is shown in the following figure.

Figure 13:
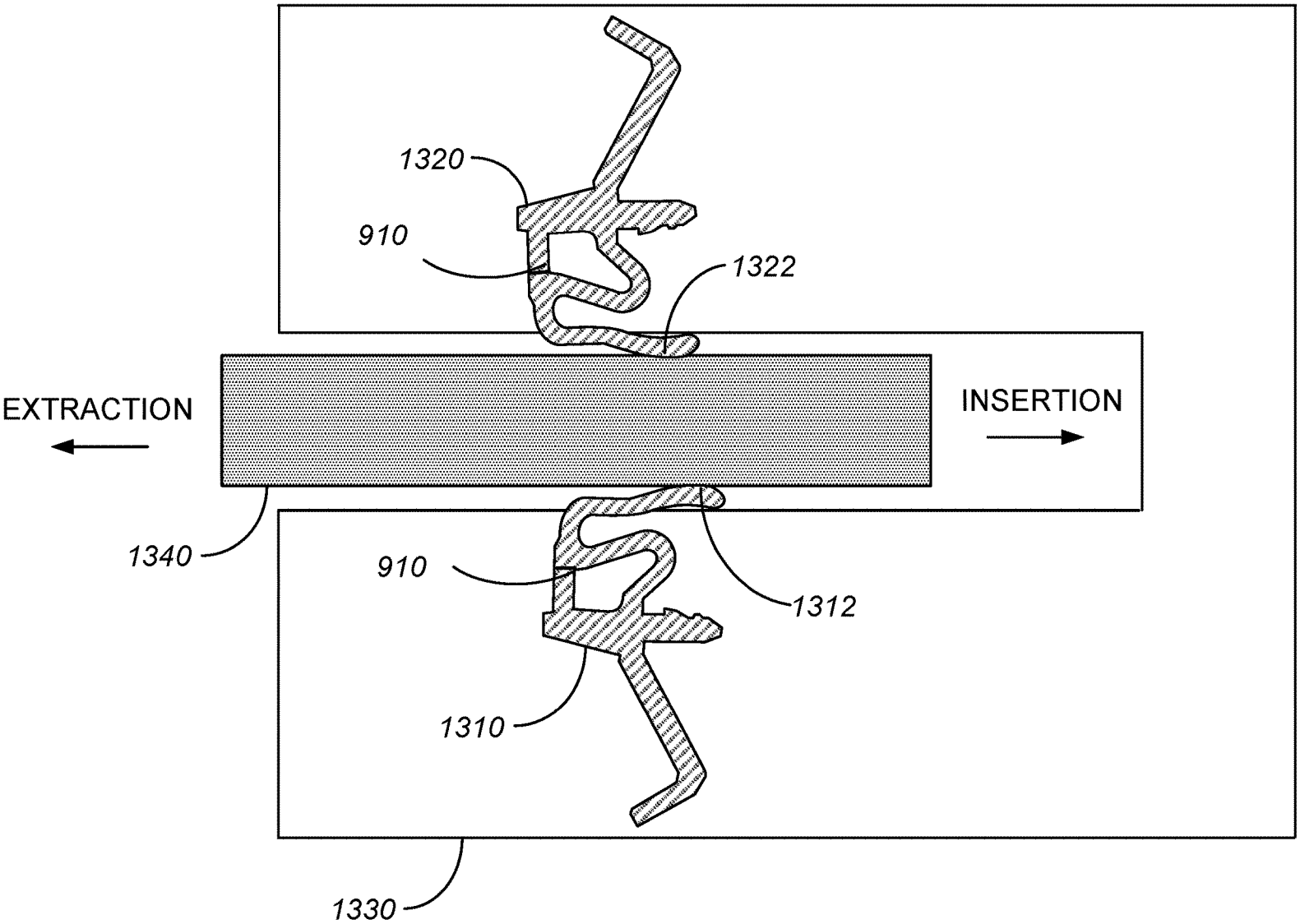
FIG. 13 illustrates a connector system utilizing contacts according to an embodiment of the present invention.

FIG. 13 illustrates a connector system utilizing contacts according to an embodiment of the present invention. In this example, housing 1330 may support contacts 1310 and 1320. Contacts 1310 and 1320 may be the same or similar to contacts 710 in FIG. 7. Contacts 1310 and 1320 may be split at locations 910 in the same or similar way as contacts 710 in FIG. 7. Contacts 1310 and 1320 may have contacting portions 1312 and 1322, which may be extend from housing 1330. Tongue 1340 may include contacts (not shown) that may physically and electrically contact contacting portions 1312 and 1322. Tongue 1340 may be a tongue of a connector receptacle or a tongue of a connector insert. Housing 1330 may be a housing of a connector insert or a connector receptacle. Housing 1330 may be a housing for a connector receptacle, or it may be a section of a device enclosure for an electronic device housing the connector receptacle. In this example, an insertion force needed to insert tongue 1340 into housing 1330 may be lower than a corresponding extraction force. Again, this may help to prevent damage to contacts 1310 and contacts 1320. The higher extraction force may also help to secure tongue 1340 in place in housing 1330. These forces are illustrated in the following figure.

Figure 14:
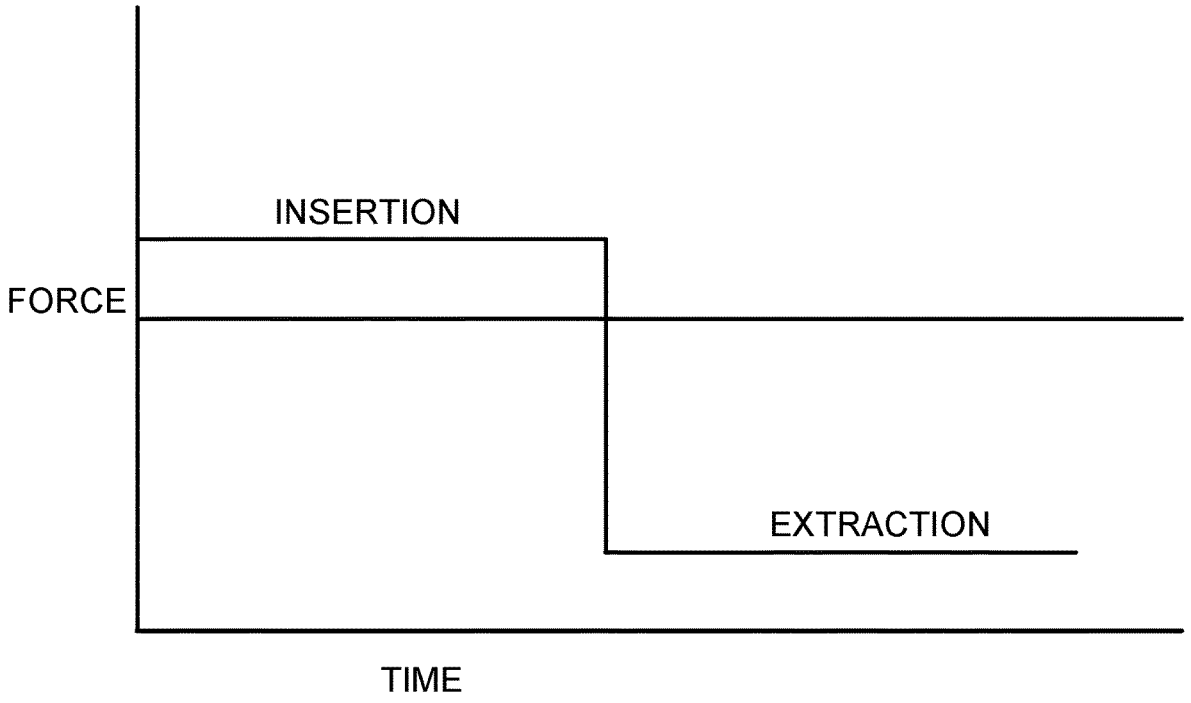
FIG. 14 illustrates the relative insertion and extraction forces of a card and socket, or a connector tongue and corresponding connector, according to an embodiment of the present invention.

FIG. 14 illustrates the relative insertion and extraction forces of card and corresponding socket, or a connector tongue and corresponding connector, according to an embodiment of the present invention. In this example, as time progresses, a card is inserted into a socket, and then extracted. Alternatively, in this example, as time progresses, a connector tongue is inserted into a connector housing, and then extracted. As can be seen, insertion and extraction forces are in the opposite directions and the extraction force has a higher magnitude than the insertion force.

Embodiments of the present invention may be used to provide sockets that may hold one or more cards. These cards may be memory cards, such as SO-DIMM, DIMM, or other cards. They may also be other types of cards, such as graphics cards, networking cards, audio cards, or other types of cards, boards, modules, or other devices.

In various embodiments of the present invention, contacts, tabs, latches, and other conductive portions of a socket, connector insert, or connector receptacle may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as housings and other structures may be formed using injection or other molding, 3-D printing, machining, or other manufacturing process. The nonconductive portions may be formed of silicon or silicone, rubber, hard rubber, plastic, nylon, liquid-crystal polymers, ceramics, or other nonconductive material or combination of materials. These sockets may be attached or be mounted on printed circuit boards or other boards that may be formed of FR-4 or other material.

Embodiments of the present invention may provide sockets, connector inserts, or connector receptacles that may be located in various types of devices such as portable computing devices, tablet computers, desktop computers, laptops, all-in-one computers, wearable computing devices, smart phones, storage devices, portable media players, navigation systems, monitors, power supplies, video delivery systems, adapters, remote control devices, chargers, and other devices. The sockets may be sockets for small outline dual in-line memory module sockets, dual in-line memory module sockets, or other types of memory or other sockets. They may also be other types of sockets, such as sockets for graphics cards, networking cards, audio cards, or other types of cards, boards, modules, or other devices. These connector receptacles and connector inserts may provide interconnect pathways for signals that are compliant with various standards such as one of the Universal Serial Bus standards including USB Type-C, High-Definition Multimedia Interface, Digital Visual Interface, Ethernet, DisplayPort, Thunderbolt, Lightning, Joint Test Action Group, test-access-port, Directed Automated Random Testing, universal asynchronous receiver/transmitters, clock signals, power signals, and other types of standard, non-standard, and proprietary interfaces and combinations thereof that have been developed, are being developed, or will be developed in the future. Other embodiments of the present invention may provide sockets, connector receptacles, and connector inserts that may be used to provide a reduced set of functions for one or more of these standards. In various embodiments of the present invention, these interconnect paths provided by these sockets, connector inserts, and connector receptacles may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A contact configured to be housed in a socket, the contact comprising:

a first contact portion having a contacting portion at a first end, the contacting portion to mate with a corresponding contact on a card when the card is mated with the socket;

a second contact portion having a first end connected to a second end of the first contact portion;

a third contact portion having a first end connected to a second end of the second contact portion; and a stop defined by a break between the second contact portion and a fourth contact portion, wherein the stop limits movement of the second contact portion when the card is extracted from the socket and does not limit movement of the second contact portion when the card is inserted into the socket, wherein the first contact portion and the third contact portion are at least approximately parallel.

2. The contact of claim 1 wherein the first contact portion and the third contact portion are at least approximately orthogonal to the second contact portion.

3. The contact of claim 1 wherein the contact is a stamped contact.

4. The contact of claim 1 wherein the break between the second contact portion and the fourth contact portion is formed by shearing the contact.

5. An electronic device comprising:

a top socket for a first memory card; and a bottom socket for a second memory card, each of the top socket and bottom socket comprising:

a receptacle to accept an end of a corresponding memory card; and latch arms extending from side ends of the receptacle and each comprising a top locking feature and a bottom locking feature to hold the corresponding memory card in place, wherein the top locking feature is spaced away from the bottom locking feature on each latch arm, wherein the top locking features and the bottom locking features on the latch arms of the top socket are positioned such that the second memory card is lockable in place in the bottom socket without interference from the top locking features and bottom locking features on the latch arms of the top socket, and wherein the top locking features on the latch arms of the top socket are aligned to notches in sides of the second memory card when the second memory card is locked in place in the bottom socket.

6. An electronic device comprising:

a top socket for a first memory card; and a bottom socket for a second memory card, each of the top socket and bottom socket comprising:

a receptacle to accept an end of a corresponding memory card; and latch arms extending from side ends of the receptacle and each comprising a top locking feature and a bottom locking feature to hold the corresponding memory card in place, wherein the top locking feature is spaced away from the bottom locking feature on each latch arm, and wherein the top locking features and bottom locking features on the latch arms of the top socket are positioned between the top socket and a position where the second memory card is inserted into the bottom socket such the top locking features and bottom locking features do not interfere when the second memory card is locked in place in the bottom socket.

7. The electronic device of claim 6 wherein the top socket and the bottom socket each further comprise:

a plurality of front side contacts in the receptacle; and a plurality of back side contacts in the receptacle.

8. The electronic device of claim 7 wherein each of the front side contacts comprise:

a first contact portion having a contacting portion at a first end;

a second contact portion having a first end connected to a second end of the first contact portion;

a third contact portion having a first end connected to a second end of the second contact portion; and a stop defined by a break between the second contact portion and a fourth contact portion, wherein the stop prevents the second contact portion from moving during extraction and allows the second contact portion to move during insertion.

9. The electronic device of claim 8 wherein the first contact portion and the third contact portion are at least approximately parallel.

10. The electronic device of claim 9 wherein the first contact portion and the contact portion are at least approximately orthogonal to the second contact portion.

11. The electronic device of claim 8 wherein the break between the second contact portion and the fourth contact portion is formed by shearing.

* * * * *